US007168412B2

(12) United States Patent
Cooke et al.

(10) Patent No.: US 7,168,412 B2
(45) Date of Patent: Jan. 30, 2007

(54) INJECTION NOZZLE

(75) Inventors: Michael P. Cooke, Gillingham (GB); Andrew J. Limmer, St. Edmunds (GB)

(73) Assignee: Delphi Technologies, Inc., Troy, MI (US)

( * ) Notice: Subject to any disclaimer, the term of this patent is extended or adjusted under 35 U.S.C. 154(b) by 128 days.

(21) Appl. No.: 11/035,169

(22) Filed: Jan. 13, 2005

(65) Prior Publication Data

US 2005/0173565 A1 Aug. 11, 2005

(30) Foreign Application Priority Data

Jan. 13, 2004 (EP) ..... 04250132

(51) Int. Cl.
*F02M 51/00* (2006.01)
*F02M 59/00* (2006.01)

(52) U.S. Cl. ..... 123/468; 239/500; 239/584; 239/533.12

(58) Field of Classification Search ..... 123/445, 123/446, 468; 239/499, 500, 502, 533.2, 239/533.9, 533.12, 583, 584
See application file for complete search history.

(56) References Cited

U.S. PATENT DOCUMENTS 3,612,407 A 10/1971 Itano
4,083,498 A 4/1978 Cavanagh et al.
4,721,253 A * 1/1988 Noguchi et al. ..... 239/464
4,934,599 A * 6/1990 Hasagawa ..... 239/88
6,663,024 B2 * 12/2003 Boecking ..... 239/533.2
2002/0158152 A1 * 10/2002 Hockenberger ..... 239/533.12
2002/0179748 A1 12/2002 Dantes et al.
2003/0057298 A1 3/2003 Boecking
2004/0211846 A1 * 10/2004 Chenanda et al. ..... 239/132.5

FOREIGN PATENT DOCUMENTS

AT 372163 9/1983

(Continued)

*Primary Examiner*—John T. Kwon
(74) *Attorney, Agent, or Firm*—David P. Wood

(57) ABSTRACT

An injection nozzle for an internal combustion engine has a valve member moveable within a bore of a nozzle body, and a seating surface defining a seat cone angle the valve member including a first frustoconical valve region, a second frustoconical valve region, and an annular groove defining, in part, a delivery chamber in communication with at least one nozzle outlet. The annular groove is disposed intermediate the first and second valve regions such that a first seating line is defined at the mutual interface between the first valve region and the annular groove and is engageable with the seating surface to control delivery of fuel from a first supply chamber to the deliver chamber, and a second seating line is defined at the mutual interface between the second valve region and the annular groove and is engageable with the seating surface to control delivery from a second supply chamber to the delivery chamber. The second supply chamber is in communication with the first supply chamber by way of a flow path defined within the valve member and as the first and second seating lines are disengaged from the seating surface, fuel is permitted to flow past the first and second seating lines into the at least one nozzle outlet. By virtue of the provision of the first and second valve seats, the flow path and the delivery chamber, the injection nozzle exhibits improved fuel delivery characteristics.

9 Claims, 7 Drawing Sheets

FOREIGN PATENT DOCUMENTS

| | | |
|---|---|---|
| DE | 843765 | 7/1952 |
| EP | 1063416 | 12/2000 |
| FR | 2328855 | 5/1977 |
| FR | 59-82574 | 5/1984 |
| GB | 240336 | 1/1925 |
| GB | 2158151 | 11/1985 |
| JP | 62-38871 | 2/1987 |

* cited by examiner

INJECTION NOZZLE

The invention relates to an injection nozzle for use in a fuel injection system for an internal combustion engine. In particular, but not exclusively, the invention relates to an injection nozzle for use in a compression ignition internal combustion engine, in which a valve needle is engageable with a seating surface to control injection of fuel into an associated combustion space through one or more nozzle outlets.

In one known injection nozzle, a VCO-type (valve covered orifice) as shown in FIG. 1 for example, a valve needle 10 has a seating "line" 12 which engages with a seating surface 13 defined by an internal surface of a nozzle body bore 14 within which the valve needle 10 is moveable. In use, as the valve needle 10 is moved away from the seating surface 13, injection nozzle outlets 16 are opened to enable high pressure fuel to be injected to the associated engine cylinder. When the valve needle 10 is moved into engagement with the seating surface 13, the outlets 16 are closed and injection is terminated.

A benefit of VCO-type nozzles is that the valve needle 10 covers the outlets 16 so injection stops rapidly when the valve needle closes. This is to be compared with "sac-type" nozzles in which the outlets extend from a small "sac" or volume defined at the blind end of the nozzle bore. In sac-type nozzles, therefore, the valve needle merely interrupts fuel flow to the sac so, following termination of injection, a small amount of residual fuel remains in the sac to leak into the combustion chamber. A rapid cessation of an injection event is important in the reduction of environmentally harmful exhaust emissions, particularly smoke and particulates, since the quantity of unburnt or partially burnt fuel in the exhaust is reduced. In addition, VCO-type nozzles permit the sac of sac-type nozzles to be substantially eliminated, so reducing the retention of fuel between the valve needle seat 13 and the injection nozzle outlets after an injection event. By virtue of this low "trapped volume", exhaust emissions can be improved further.

Whilst VCO type nozzles have particular advantages, a recognised problem is that since the valve needle occludes the outlets, at low values of needle lift the limited clearances between the surface of the valve needle and the outlets restrict the fuel flow into the outlets and so high flow rates are compromised. Fuel flow is further restricted due to the annular gap defined between the seating line and the seating surface when the valve needle lifts from the seating surface.

It is desirable, however, to achieve high flow rates through VCO-type nozzles at relatively low needle lifts since the advantages of reduced particulate emissions can be realised with the additional benefits of increased energy efficiency of the injector actuator. This is particularly significant in directly actuated piezoelectric VCO-type injector nozzles in which the energy required to lift the needle from its seating is provided by means of a piezoelectric stack.

It is against this background that the present invention has been devised and it is an object of the present invention to provide a fuel injector which substantially avoids or at least alleviates some of the aforementioned problems.

In accordance with a first aspect of the invention, there is provided an injection nozzle for an internal combustion engine comprising valve means moveable within a bore of a nozzle body, the valve means having a first seat and a second seat, both being engageable with a seating surface, which has a seat cone angle, to control fuel delivery through at least one nozzle outlet, the first seat controlling delivery of fuel from a first supply chamber to a delivery chamber and the second seat controlling delivery of fuel from a second supply chamber to the delivery chamber, the second supply chamber being in communication with the first supply chamber by way of a flow path defined within the valve means, wherein as the first and second seats are disengaged from the seating surface, fuel is permitted to flow past the first and second seats into the at least one nozzle outlet.

Preferably, the valve means may take the form of a valve member.

A volume for the delivery chamber may be defined, in part, by an annular groove provided on the valve member intermediate the first and second seats.

Since fuel flow into the nozzle outlets though the delivery chamber is controlled by way of the first and second seats, a greater flow fuel rate is possible when compared to a conventional VCO-type nozzle having a single seat. In addition, fuel is permitted to flow into the outlets from both upstream and downstream directions, relative to the first supply chamber, so the balance of the fuel spray injected into the combustion chamber is improved.

In one embodiment of the invention, the first seat may take the form of a first seating line and the valve member may include a first valve region of frustoconical form defining a first cone angle. The annular groove may also include a first groove region of frustoconical form defining a second cone angle. The first and second cone angles may be selected to define the first seating line at the mutual interface of the first valve region and the first groove region.

The first cone angle and the seat cone angle define a first differential angle therebetween and the second cone angle and the seat cone angle define a second differential angle therebetween and, in order to minimise seat wear and to avoid migration of the first seating line, the first and second differential angles may be selected so that they are substantially the same.

In an alternative embodiment, the first seat may take the form of a seat area defined by the first valve region, rather than a first seating line defined at the mutual interface of the first valve region and the first groove region.

The second seat may also take the form of a second seating line and, accordingly, the valve member may include a second valve region of frustoconical form defining a fourth cone angle. The annular groove may also include a second groove region of frustoconical form defining a third cone angle. The third and fourth cone angles may be selected so as to define the second seating line at the mutual interface of the second valve region and the second groove region.

As described with respect to the first seat, the third cone angle and the seat cone angle define a third differential angle therebetween and the fourth cone angle and the seat cone angle define a fourth differential angle therebetween and, in order to minimise seat wear and to avoid migration of the second seating line, the third and fourth differential angles may be selected so that they are substantially the same.

Alternatively, the second seat may be a seat area defined by the second valve region rather than a second seating line defined at the mutual interface of the second valve region and the second groove region.

It is a feature of the invention that pressurised fuel for injection is supplied to the second supply passage from the first supply passage by way of a flow path. Preferably, the flow path comprises an axial passage extending at least part way along the valve member, one end of which being in communication with the second supply chamber. Preferably, the second supply chamber is defined at the blind end of the bore.

The flow path may also comprise at least one radial passage provided in the valve member, the radial passage effecting communication between the first supply chamber and the axial passage. It will therefore be appreciated that pressurised fuel is in constant communication with the second supply chamber.

It has been recognised that manufacturing the two seats of the valve member to ensure both seats seal simultaneously may prove impractical to manufacture efficiently. Therefore, in accordance with a second aspect of the present invention, there is provided an injection nozzle for an internal combustion engine comprising a valve member having a first seat and an axial passage, wherein an insert member having a second seat is received by the axial passage, both seats being engageable with a seating surface to control fuel delivery through a nozzle outlet, the first seat controlling delivery of fuel from a first supply chamber to a delivery chamber and the second seat controlling delivery of fuel from a second supply chamber to the delivery chamber, the second supply chamber being in communication with the first supply chamber by way of a flow path defined within the valve member.

Since the second seat is provided by the insert member, moderate manufacturing techniques are required since the first seat may be provided on the valve member itself whilst the insert member can be suitably arranged to establish the second seat such that the first and second seats seal substantially simultaneously.

In a manner similar to the injection nozzle of the first aspect of the invention, the valve member may include a first valve region of frustoconical form, defining a first cone angle and a second valve region, also of frustoconical form defining a second cone angle. Preferably, the first seat is a seat area defined by the second valve region.

Preferably, the insert member includes a first insert region of frustoconical form defining a third cone angle and a second insert region of frustoconical form defining a fourth cone angle, the second seat being defined by the second insert region. In turn, the second and third cone angles are selected so that the first insert region and the second valve region define a volume for the delivery chamber.

It will therefore be appreciated that by virtue of the insert member, an injection nozzle in accordance with the invention may more easily be manufactured whilst retaining the benefits of high fuel flow rates at low needle lift and improved spray characteristics.

The invention will now be described, by way of example only, with reference to the accompanying drawings in which.

Figure 2A:
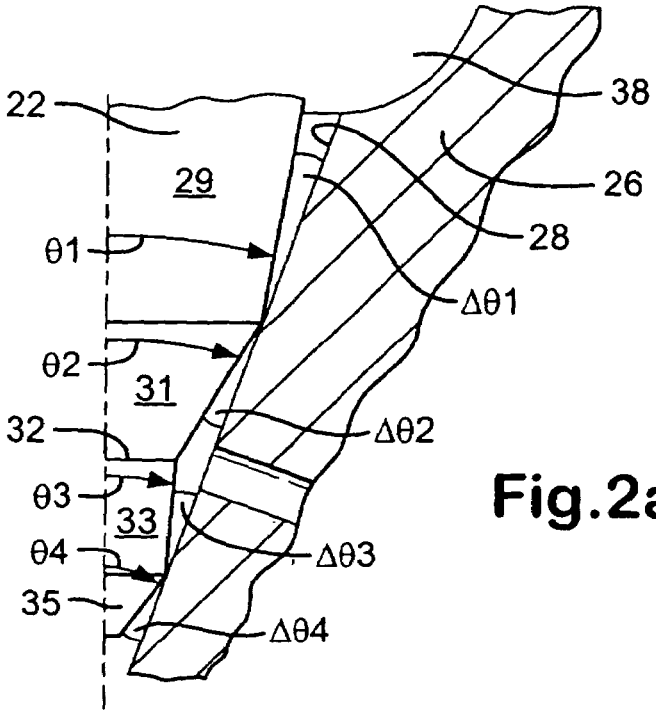
FIG. 2 is a part sectional view of a first embodiment of the injection nozzle of the present invention.
Figure 2:
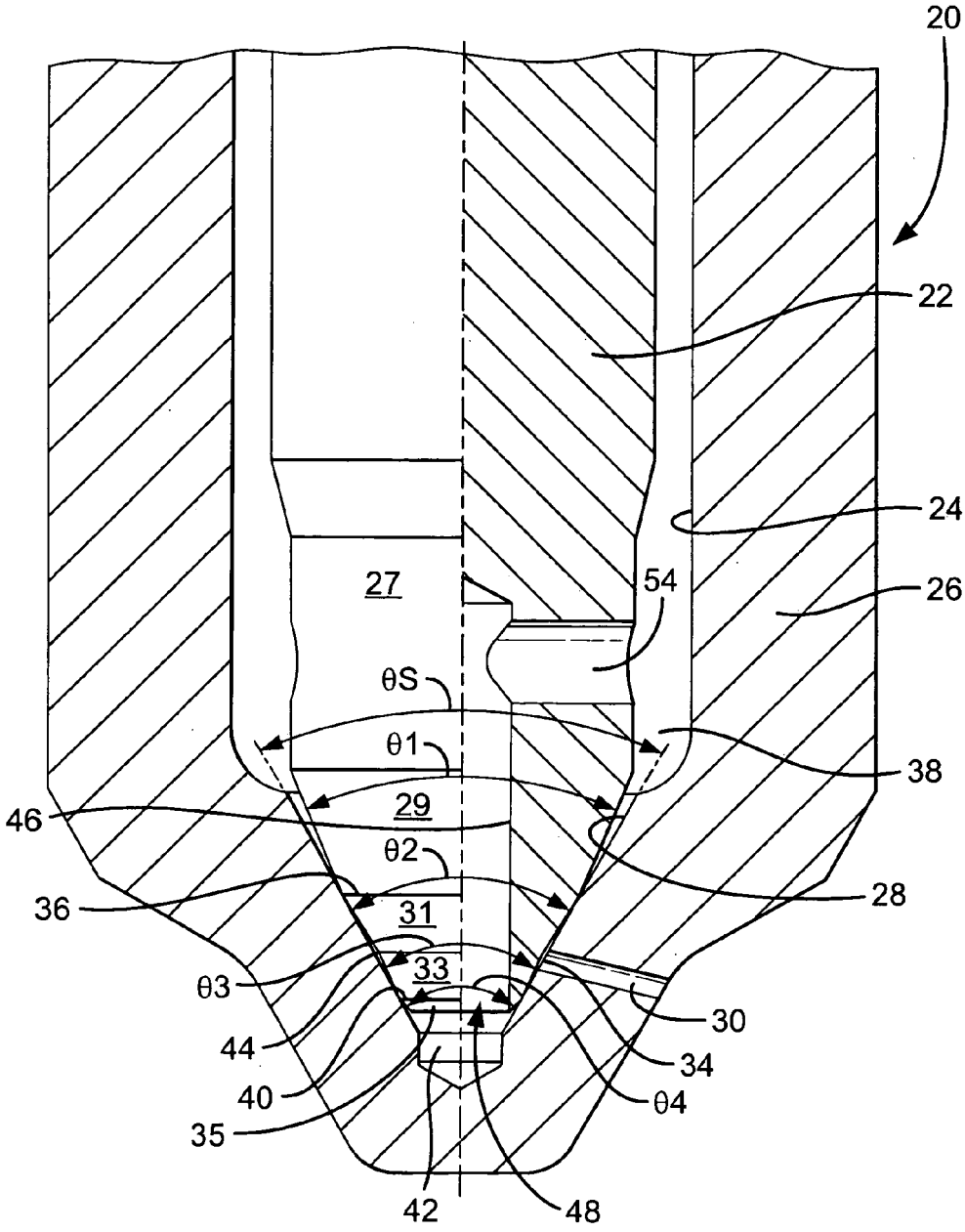
Figure 3:
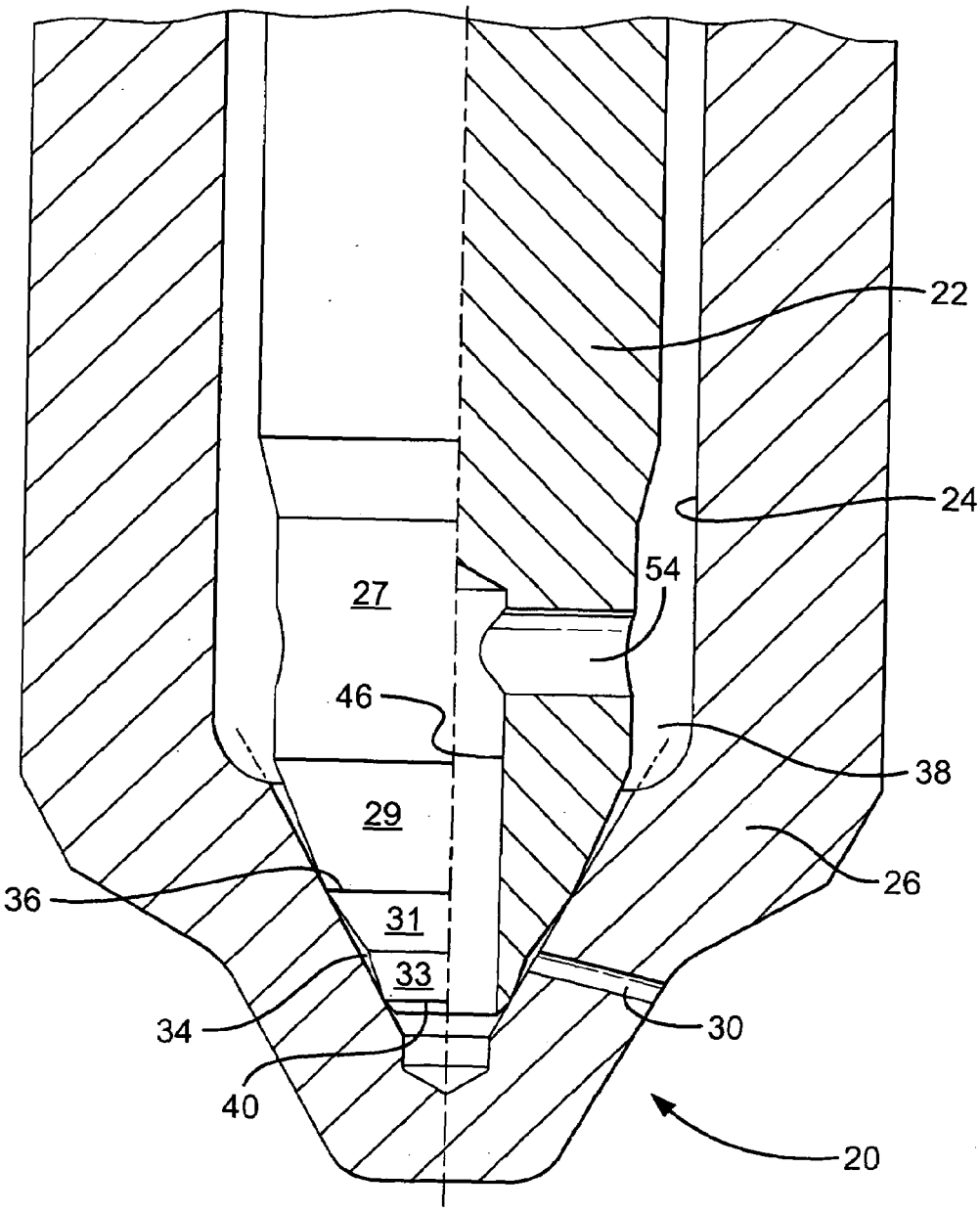
Figure 4:
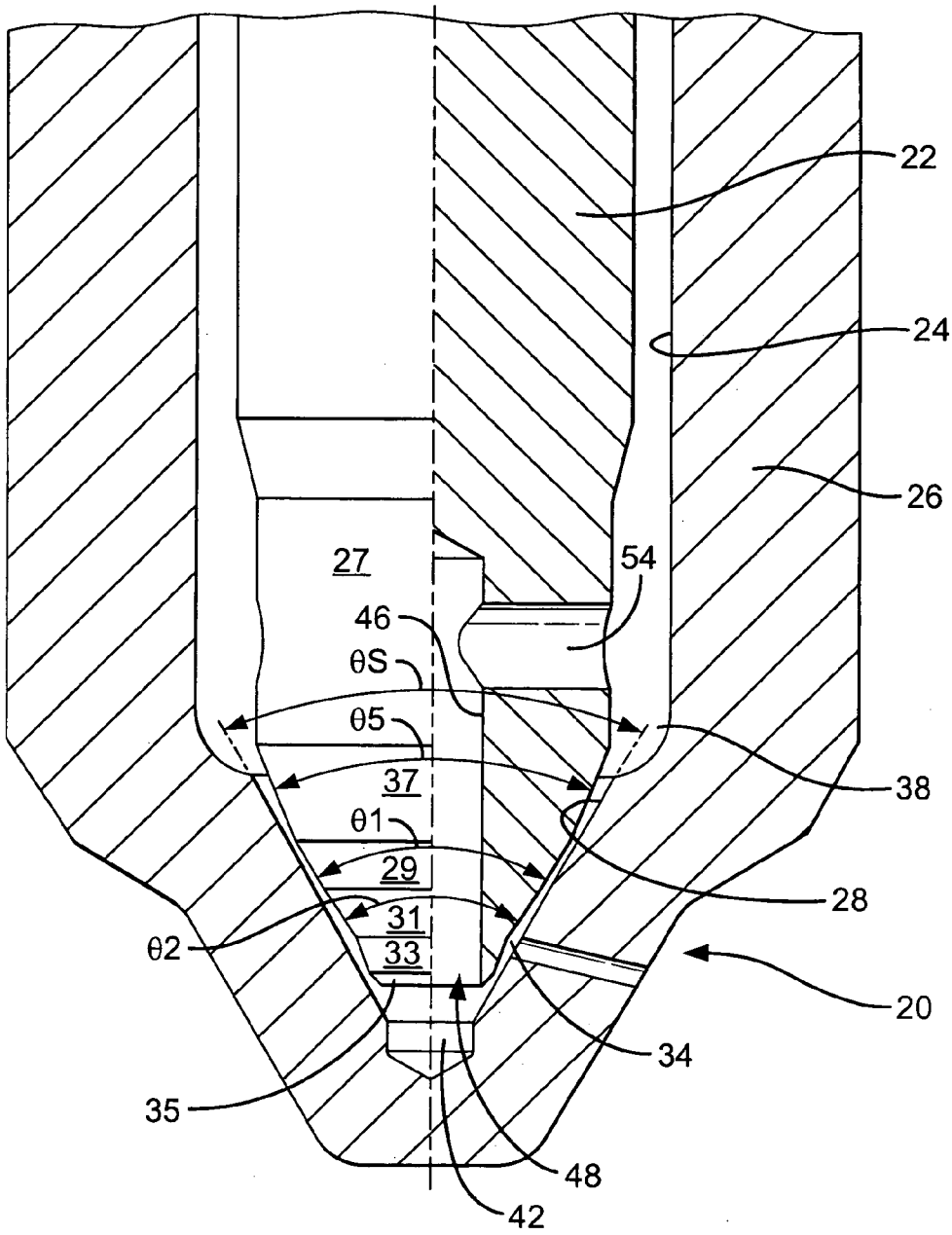
Figure 5:
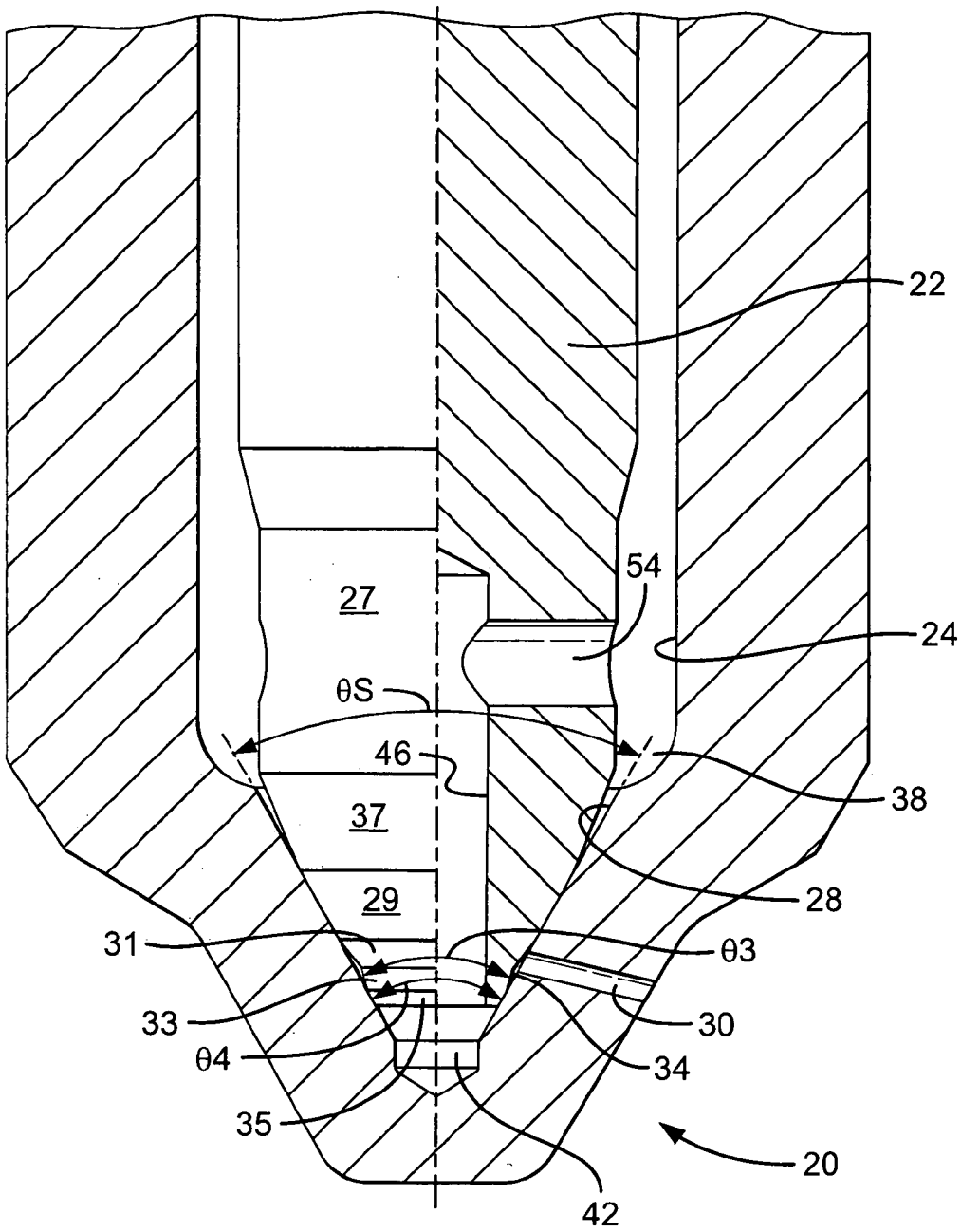
Figure 6:
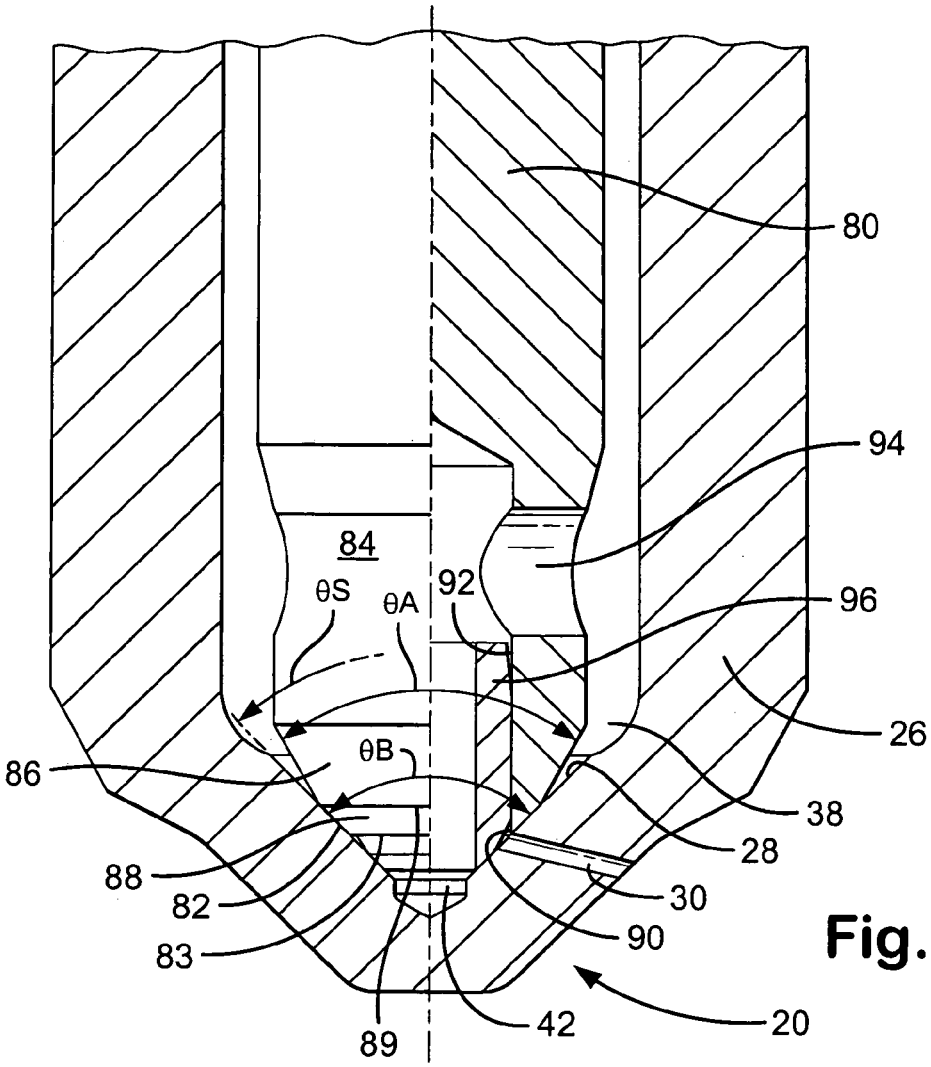
Figure 6A:
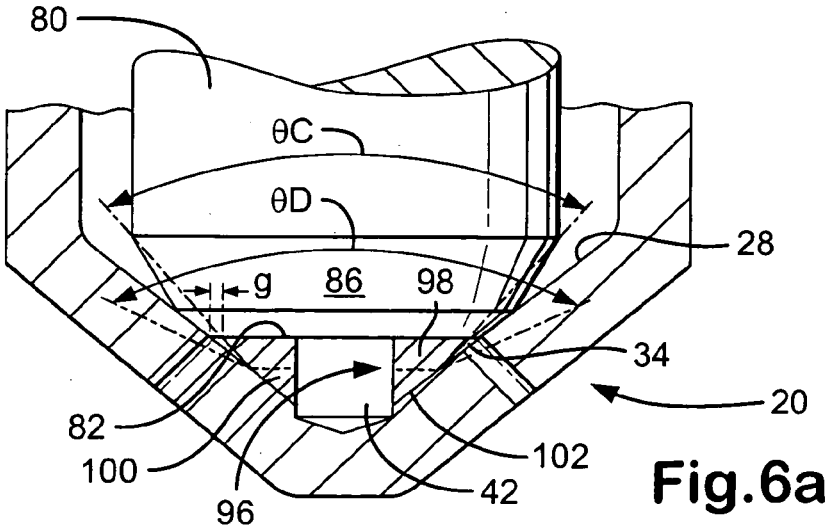
Figure 7:
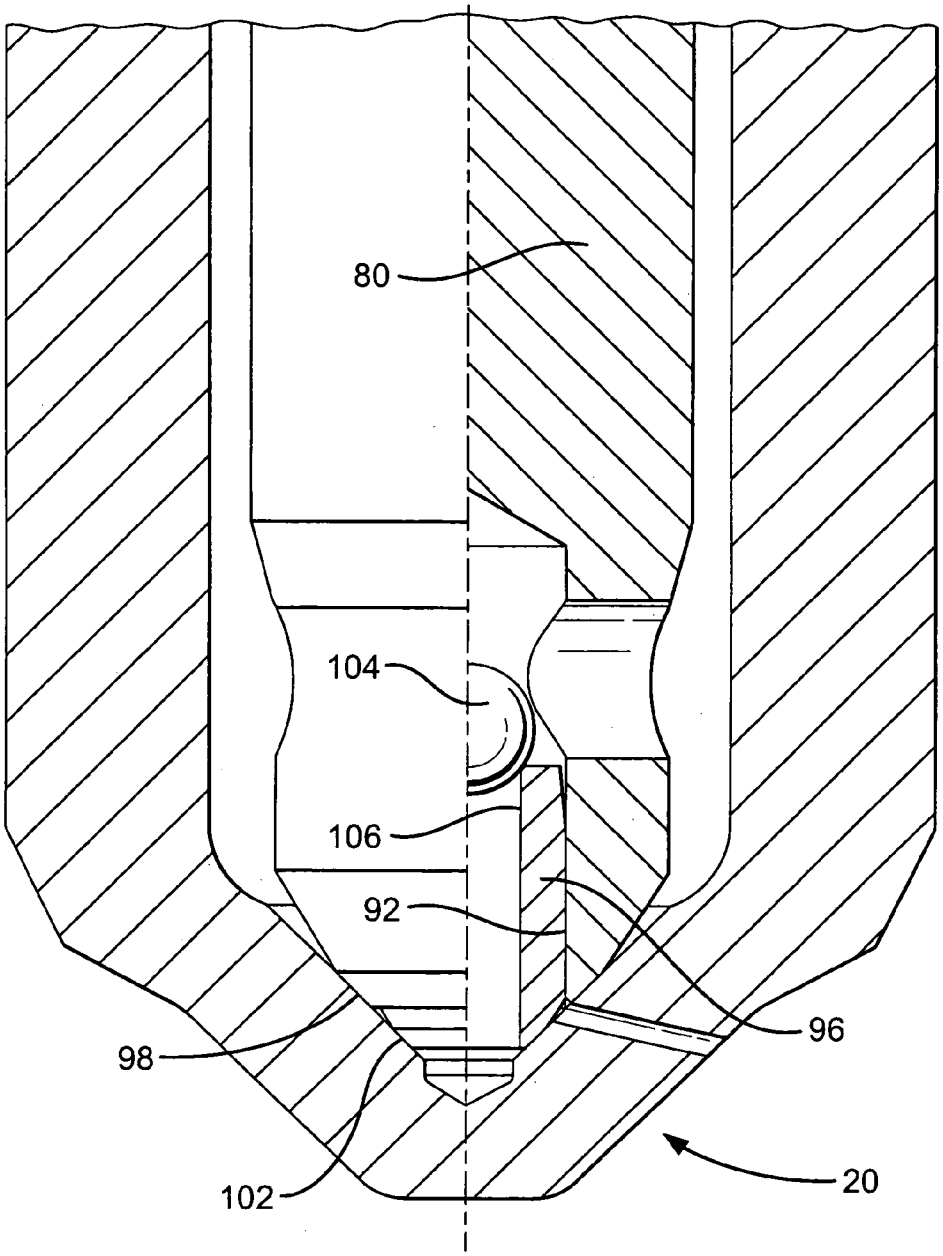

FIG. 2*a* is an enlarged view of a portion of the injection nozzle in FIG. 2;

FIG. 3 is a part sectional view of a second embodiment of the present invention having a delivery chamber of increased volume;

FIG. 4 is a part sectional view of a third embodiment of the present invention, in which the valve member has an additional frustoconical region;

FIG. 5 is a part sectional view of a fourth embodiment of the present invention;

FIG. 6 is a part sectional view of a fifth embodiment of the present invention having a tubular insert;

FIG. 7 is a part sectional view of the nozzle of FIGS. 6 and 6*a* showing additional components for manufacturing purposes.

Figure 1:
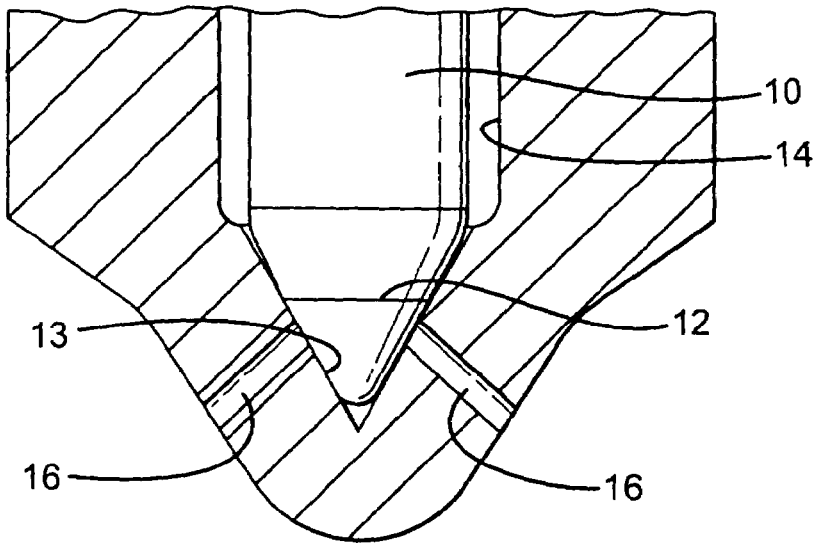
Prior Art Fig.1
FIG. 1 is a sectional view of a known VCO-type injection nozzle.

Referring to FIG. 2, an injection nozzle of a first embodiment of the invention is shown which provides improved fuel delivery characteristics over the nozzle shown in FIG. 1. The injection nozzle, indicated generally at 20, includes valve means in the form of a valve member or needle 22 that is slidable within a blind bore 24 provided in a nozzle body 26 and engageable with a conical seating surface 28 defined by the bore 24 to control fuel injection into an associated combustion space or cylinder (not shown). The seating surface 28 defines a seat cone angle θS.

The valve needle 22 is moveable by means of direct piezoelectric actuation or, alternatively, by means of a piezoelectrically actuated control valve arrangement (not shown). Still alternatively, the valve needle may be actuated by electromagnetic or hydraulic means. The manner in which the valve needle 22 may be moved within the bore would be familiar to a person skilled in this technological field.

The nozzle body 26 is provided with at least a first set of nozzle outlets 30, which extend radially from the conical seating surface 28 to the external surface of the nozzle body 26 and so provide a flow path for high pressure fuel into a combustion chamber (not shown) from an injection nozzle delivery chamber 34. Although only a first set of outlets 30 is shown here, it will be appreciated that more than one set of outlets 30 may be provided. The valve needle 22 is provided with an annular groove or recess 44 which defines, in part, a volume for the delivery chamber 34 together with the seating surface 28 such that the outlets 30 are in approximate alignment with and open into the delivery chamber 34, the advantage of which will be described later.

The valve needle 22 of this embodiment of the invention is provided with five distinct regions. A stem region 27 as shown in FIG. 2 is substantially of cylindrical form and constitutes the stem of the valve needle 22. As is usual in the art, some form of control arrangement (not shown) is provided at the upper end of the valve needle 22 for controlling valve needle movement.

A first frustoconical valve region 29 is arranged immediately downstream of the stem region 27 and defines a first cone angle θ1. Immediately downstream of the first region 29, the valve needle 22 includes a first frustoconical groove region 31 which forms part of the annular groove 44 and defines a second cone angle θ2. The valve region 29 and groove region 31 together define a first seat 36, which in this embodiment is an annular seating line, at their mutual interface. The first seating line 36 is engageable with the seating surface 28 to control fuel flow into the delivery chamber 34 from a first supply chamber 38 that lies upstream of the first seating line 36. The first supply chamber 38 is defined by the bore 24 of the nozzle body 26 and the outer surface of the valve needle 22. In use, the first supply chamber 38 is supplied with pressurised fuel for injection in a known manner, for example, from a common rail fuel supply.

A second frustoconical groove region 33, defining a third cone angle θ3, is arranged immediately downstream of the first groove region 31 and defines, at its downstream edge, a second valve needle seat 40. In this embodiment, the second seat 40 is an annular seating line and is engageable with the seating surface 28 to control fuel flow into the delivery chamber 34 from a second supply chamber 42. The second supply chamber 42 lies downstream of the first supply chamber 38 and is defined by the blind end of the bore 24. A volume for the delivery chamber 34 is defined, in part, by the first and second groove regions 31, 33 (i.e. intermediate the first seating line 36 and the second seating line 40) so as to align approximately with the outlets 30.

The valve needle 22 terminates in a second valve region 35, defining a fourth cone angle θ4, which constitutes a chamfered needle tip in this embodiment. The second valve region 35 extends into a sac volume defined at the blind end of the bore 24 and defines, together with the nozzle body bore 24, the second supply chamber 42.

A blind bore or passage 46 extends axially from an opening 48 in the tip of the needle 22 and communicates with the first supply chamber 38 by way of a radial drilling or passage 54 provided in the cylindrical stem region 27. The radial passage 54 intersects the axial passage 46 so as to form a "T-shaped" flow path for fuel between the first supply chamber 38 and the second supply chamber 42.

The annular groove 44 defines the first and second groove regions 31, 33, the groove regions 31, 33 being shaped so that the deepest part of the groove is defined at their mutual interface 32. To achieve this, the cone angle θ2 defined by the first groove region 31 is greater than the cone angle θS defined by the seating surface 28 and the cone angle θ3 of the second groove region 33 is less than the cone angle θS defined by the seating surface 28.

When it is required to inject fuel into the combustion chamber, the valve needle 22 is actuated or otherwise caused to lift so that the first and second seating lines 36, 40 move away from the seating surface 28. As the first seating line 36 lifts from the seating surface 28, fuel is permitted to flow along a first flow path from the first supply chamber 38, past the annular gap formed between the first seating line 36 and the seating surface 28 and thus through the outlets 30 and into the combustion chamber.

Simultaneously, a second flow path is established by the second seating line 40 lifting from its seating surface 28 whereby fuel is permitted to flow from the first supply chamber 38, via the radial passage 54 and axial passage 46, downstream to the second supply chamber 42. Fuel then flows from the second supply chamber 42, through the annular gap formed between the second seating line 40 and the seating surface 28 and into the delivery chamber 34, thus through the outlets 30 and into the combustion chamber.

From the foregoing description, it will be appreciated that the quantity of fuel that can be injected from the outlets 30 for a given needle lift is substantially increased by virtue of two flow paths, one past the first seating line 36 directly from the first supply chamber 38 and one past the second seating line 40 indirectly from the first supply chamber 38, via the passages 46, 54 and the second supply chamber 42. Therefore, for small levels of needle lift particularly, fuel flow to the outlets 30 is increased in comparison with a conventional VCO-type nozzle as exemplified by FIG. 1.

A further benefit of the above described arrangement is that fuel is permitted to flow into the delivery chamber 34 and into the mouth of the outlets 30 from relative upstream and downstream directions simultaneously. Fuel supply to the outlets 30 is thus substantially symmetrical in contrast to a conventional VCO-type nozzle, as shown in FIG. 1 for example, in which fuel supply is biased to the upstream side of the outlets 16. A more uniform or substantially symmetrical supply of fuel to the outlets improves the fuel spray balance into the combustion chamber, which in turn reduces smoke produced in the exhaust.

It will be apparent that the total flow area is increased by the provision of the two seating lines 36, 40 and the second flow path (i.e. through passages 46, 54). Additionally, flow restriction is reduced, hence fuel flow is increased, by arranging the annular groove 44 in approximate alignment with the outlets 30. Fuel flow is increased since there is greater clearance between the mouth of the outlets 30 and the valve needle 22. The provision of the annular groove 44 adjacent the outlets 30 therefore alleviates the disadvantageous effects of the flow restriction common to known VCO-type nozzles.

A still further benefit is that by positioning the annular groove 44 in approximate alignment with the outlets 30, the spray characteristics of the nozzle have improved uniformity or "balance" since fuel flow into the outlets 30 is less effected by radial eccentricities of the valve needle 22. This ensures progressive combustion of fuel in the combustion chamber and reduces exhaust smoking.

It will be apparent to the skilled reader that the second supply chamber 42 is constantly supplied with fuel at injection pressure since it is in communication with the first supply chamber 38. Therefore, pressurised fuel acts on the second valve region 35 and thus provides an additional lift force for the valve needle 22 as it starts to move away from the seating surface 28, thus reducing the energy required to lift the needle (by a piezoelectric actuator for example). The second supply chamber 42 provides a further benefit in that during termination of injection, fuel displaced by the needle is accommodated by the axial passage 46 rather than being forced past the first seat 36 in a reverse direction, therefore assisting valve needle closure.

As well as providing a second flow path for fuel, the axial passage 46 imparts lateral flexibility to the valve needle 22 so that the slight eccentricities in the dimensions of the first or second seating lines 36, 40 may be accommodated by the nozzle body 26 whilst still providing an effective seal during non-injecting positions.

The dimensions and respective cone angles of the first valve region 29 and first groove region 31 that define the first seating line 36, and of the second valve region 35 and second groove region 33 that define the second seating line 40, may be selected so as to ensure seat wear occurs in approximately equal amounts on both upstream and downstream sides of each of the first and second seating lines 36, 40. Ensuring balanced seat wear avoids or at least minimises injector delivery drift. For this to be achieved, and as shown exaggerated in FIG. 2*a*, the differential angles Δθ2 between the cone angle θ1 of the first valve region 29 and the seat cone angle θS, Δθ2 between the cone angle θ2 of the first groove region 31 and the seat cone angle θS, Δθ3 between the cone angle θ3 of the second groove region 33 and the seat cone angle θS, and Δθ4 between the cone angle θ4 of the second valve region 35 and the seat cone angle θS are selected to be relatively small, typically around 0.5° to 30°.

FIG. 3 shows an alternative embodiment of the fuel injector nozzle, in which similar parts to those shown in FIG. 2 are denoted by like reference numerals. Many features of the nozzle of FIG. 3 are identical to those in FIG. 2 and so will not be described in detail again.

In contrast to the embodiment in FIG. 2, the embodiment of FIG. 3 is provided with a volumetrically increased delivery chamber 34 so as to maximise the fuel flow rate during conditions of low needle lift. As has been previously described, VCO-type nozzles tend to restrict flow rate at low needle lift since fuel flow is restricted not only between the valve seating line and the seating surface, but also due to the limited clearance between the valve needle and the outlets.

In this embodiment of the invention, the differential angles Δθ2 and Δθ3 are increased, thus deepening the annular groove 44 and so enlarging the volume of the delivery chamber 34. In addition, the axial length of the second groove region 33 is less than the axial length of the first groove region 31 so that their mutual interface 32 is slightly offset in the downstream direction from alignment with the outlets 30, when the needle is seated. It will be apparent, therefore, that at relatively low values of needle lift, the deepest part of the annular groove 44 will substantially align with the outlets 30 so improving fuel flow and spray distribution.

Whilst the deeper annular groove 44 may further alleviate the restriction of fuel into the outlets 30, and so improve the fuel spray characteristics, the increased differential angles Δθ2 and Δθ3 also have the effect of increasing wear of the two seating lines 36, 40. As this may cause the "effective" seating line to migrate in either an upstream or downstream direction, thus influencing the "opening pressure" of the nozzle, it is important to choose the depth of the groove 44 appropriately.

Furthermore, to minimise delivery drift, it is desirable to select the differential angles Δθ1, Δθ2, Δθ3 and Δθ4 to be as small as possible. For this purpose, FIG. 4 shows a further embodiment of the invention, again in which similar parts to those described previously are denoted with like reference numerals. In FIG. 4, the valve needle 22 is provided with a further frustoconical region 37 defining a cone angle θ5, which is located immediately upstream of the first valve region 29. The cone angle θ1 of the first valve region 29 now defines a cone angle θ1 that differs from that of previous embodiments in that it is substantially the same as the seat cone angle θS. Therefore, the valve needle 22 seats against the seating surface 28 by way of the frustoconical surface area of the first valve region 29, rather than at a seating line as in previous embodiments. In practice, however, it is likely that the cone angle θ1 of the first valve region 29 in this embodiment is selected to differ slightly from the seat cone angle θS, such that it can be known which edge of the first valve region 29 will contact the seating surface 28 first.

It will be appreciated that the difference between the cone angles θ1, θ2 of the first valve region 29 and the first groove region 31, respectively, are reduced when compared with the embodiments of FIGS. 2 and 3 and so migration of the seat will be reduced or substantially avoided.

Likewise, in the embodiment of FIG. 5, the cone angle θ4 of the second valve region 35 is reduced to minimise the differential angle Δθ4 between the cone angle θ4 and the seat cone angle θS. Indeed, in FIG. 5, the cone angle θ4 is set so as to be substantially the same as the seat cone angle θS such that the valve needle 22 seats against the seating surface 28 by way of the frustoconical surface area of the second valve region 35, rather than a second seating line as in previous embodiments. The provision of the second valve region 35 with a reduced cone angle θ4 reduces the load on the second seat 40 and thus reduces or avoids seat migration. The arrangement of the first and second groove regions 31, 33 dictates the dimensions of the delivery chamber 34 and therefore the volume of the delivery chamber 34 can be optimised without compromising the durability of the seats. For example, as shown by the embodiment in FIG. 5, the axial lengths of the first and second groove regions 31, 33 are reduced compared to previous embodiments. In this embodiment, for instance, the depth of the delivery chamber 34 is increased so as to reduce the restriction to fuel flow at low needle lifts. However, since the axial lengths of the first and second groove regions 31, 33 are reduced, the volume of the delivery chamber 34 is minimised, thus retaining the benefits achieved by a low "trapped volume".

It will be appreciated that although the delivery chamber 34 has a triangular profile in cross-section, by virtue of the shape of the groove 44 defining the groove regions 31, 33, the valve needle 22 may also be formed so that the profile of the delivery chamber 34 is curved (i.e. a curved groove), for example.

As has been described, the importance of achieving high flow rates at low needle lifts is becoming increasingly important in injector nozzle design. It will be appreciated that by increasing the cone angles of the frustoconical regions 29, 31, 33, 35 together with the seat cone angle θS, the achievable flow area is increased for a given needle lift.

The skilled person will appreciate that highly precise manufacturing techniques are required to achieve the precise needle cone angles and seat diameters demanded by the aforementioned embodiments to ensure that both seats 36, 40 engage the seating surface 28 substantially simultaneously. In another embodiment of the invention, as exemplified by FIG. 6, there is shown a nozzle arrangement which retains the benefits of the nozzle as described in connection with previous embodiments but also alleviates the manufacturing demands associated with machining such an injector.

FIG. 6 shows another alternative nozzle arrangement and, as before, many parts are similar to previous embodiments and so are denoted by like reference numerals.

As in previous embodiments of the invention, the nozzle body 26 is provided with at least a first set of outlets 30 which extend radially from the conical seating surface 28 to the external surface of the nozzle body 26 and so provide a flow path for fuel from a first supply chamber 38 internal to the nozzle body 26 into an associated cylinder or combustion chamber. In contrast to the previous embodiments of the invention, in which the valve needle 22 defines at least five distinct regions and includes two seats 36, 40, the valve needle 80 of this embodiment is shaped to define three distinct regions and includes only a first valve needle seat 82.

A first, substantially cylindrical region 84 lies upstream of a tip of the valve needle 80 and constitutes the stem of the valve needle 80. A frustoconical first valve region 86 is disposed immediately downstream of the cylindrical region 84 and defines a first cone angle θA. Immediately downstream of the first valve region 86, the valve needle 80 includes a second frustoconical valve region 88 defining a second cone angle θB and having a downstream edge 83 at which the valve needle 80 terminates. In this embodiment, θB is substantially the same as the seat cone angle θS and so the second valve region 88 provides a first seat 82 over the area of its frustoconical surface. Although in FIG. 6, it is shown that the valve needle 80 seats on the surface area of the second valve region 88, it will be appreciated that the cone angle θB of the second valve region 88 may be greater than the seat cone angle θS, in which case a seating line would be established at the downstream edge 89 of the first valve region 86.

The downstream edge 83 of the second region 88 substantially aligns with the upstream edge of the outlets 30, when the needle is seated and defines an opening 90 at one end of an axially extending passage or blind bore 92 provided in the needle 80. The axial passage 92 extends part way into the cylindrical region 84 and the stem of the valve needle 80. A radial drilling or passage 94 is provided in the cylindrical first region 84 and intersects the axial passage 92 so as to provide a "T-shaped" flow path for fuel from the first supply chamber 38 to the second supply chamber 42.

The axial passage 92 has an enlarged cross sectional area compared to previous embodiments of the invention and accommodates a cylindrical insert member 96 of tubular form arranged co-axially within and protruding from the opening 90 of the valve needle 80. Preferably, the insert member 96 is an interference fit with the passage 92.

As can be seen more clearly in FIG. 6*a*, the insert member (shown generally as 96) has a downstream end face that is machined during manufacture so that it provides a second seat 102 for the nozzle when inserted into the valve needle 80. To achieve this, the lower end of the insert member 96 includes a first insert region 98 of frustoconical form defining a third cone angle θC. The insert member 96 terminates in a second insert region 100 of frustoconical form which is located immediately downstream of the first insert region 98. The second insert region 100 defines a cone angle θD which is substantially the same as the seat cone angle θS. Therefore, the insert member 96 seats against the seating surface 28 by way of the frustoconical surface area of the second insert region 100. The cone angle θD ay also be selected so that it is greater than the seat cone angle θS, in which case it will be appreciated that a seating line would be defined at the mutual interface between the first and second insert regions 98, 100.

In the position shown in FIGS. 6 and 6*a*, the seat 102 of the insert member 96 is engaged with the seating surface 28 and therefore, together with the first seat 82, seals the outlets 30 against the ingress of fuel from both the upstream and downstream directions.

In this embodiment of the invention, the cone angle θC of the first insert region 98 of the insert member 96 is selected so that a small radial gap 'g' exists between the peripheral edge of the second region 88 of the valve needle 80 and the first insert region 98. Therefore, when the insert member 96 and the valve needle 80 are assembled and introduced into the nozzle body 26, a delivery chamber 34 is formed in approximate alignment with the outlets 30. Therefore, the benefits associated with the existence of first and second seats 82, 102 and the presence of the delivery chamber 34 are retained in this embodiment of the invention whilst alleviating manufacturing demands. In practice, to machine the first and second seats 82, 102 on separate components calls for more moderate tolerances than forming both seats on a single valve needle.

To assemble the nozzle 20 of this embodiment, as shown in FIG. 7, a ball 104 having a diameter greater than an upstream opening 106 of the insert member 96 but less than the diameter of the axial passage 92, is provided to rest upon the upstream opening 106. The ball 104 is used to position the insert member 96 correctly within the valve needle 80 so that the first and second seats 82, 102 seal simultaneously when in a non-injecting position.

During assembly of the nozzle 20, the insert member 96 is urged into the axial passage 92 of the valve needle 80 so as to be disengaged from the seating surface 28 when the first seat 82 is engaged with the seating surface 28. Fuel pressure is then supplied to the first supply chamber 38. Since the ball 104 blocks the upstream insert opening 106, and thus blocks the axial passage 92, fuel pressure forces the ball 104 and the insert member 96 in a downstream direction so that the second seat 102 of the insert member 96 is caused to engage with the seating surface 28. When the insert member 96 is positioned correctly in this way, the nozzle 20 may be disassembled and the ball 104 then removed from the valve needle 80 altogether. The valve needle 80 is thus correctly configured for final assembly and installation.

In an alternative assembly process, initially the insert member 96 may be pressed part way into the passage 92 so that when the valve needle 80 is inserted into the nozzle body 26, the second seat 102 engages with the seating surface 28 but the first seat 82 does not. The valve needle 80 may then be urged in such a way so as to force the insert 96 further into the passage 92 until the first seat 82 is caused to engage the seating surface 28.

It will be understood by those who practice the invention and those skilled in the art, that various modifications and improvements may be made to the invention without departing from the scope of the invention as defined by the claims. Accordingly, reference should be made to the claims and other conceptual statements herein rather than the foregoing specific description in determining the scope of the invention.

The invention claimed is:

1. An injection nozzle for an internal combustion engine, the nozzle comprising a valve member moveable within a bore of a nozzle body and a seating surface defining a seat cone angle, the valve member including:

a first valve region of frustoconical form defining a first cone angle having an angle less than that of the seat cone angle;

a second valve region of frustoconical form defining a second cone angle having an angle greater than that of the seat cone angle; and an annular groove that defines, in part, a delivery chamber in communication with at least one nozzle outlet;

wherein the annular groove is disposed intermediate the first and second valve regions, respectively, such that a first seating line is defined at the mutual interface between the first valve region and the annular groove and is engageable with the seating surface to control delivery of fuel from a first supply chamber to the delivery chamber, and a second seating line is defined at the mutual interface between the second valve region and the annular groove and is engageable with the seating surface to control delivery of fuel from a second supply chamber to the delivery chamber, the second supply chamber being in communication with the first supply chamber by way of a flow path defined within the valve member, and wherein as the first and second seating lines are disengaged from the seating surface, fuel is permitted to flow past the first and second seating lines into the at least one nozzle outlet.

2. The injection nozzle as claimed in claim 1, wherein the annular groove includes a first groove region of frustoconical form defining a third cone angle and a second groove region of frustoconical form defining a fourth cone angle.

3. The injection nozzle as claimed in claim 2, wherein the first cone angle and the seat cone angle define a first differential angle therebetween and the third cone angle and the seat cone angle define a second differential angle therebetween, and wherein the first and second differential angles are substantially the same.

4. The injection nozzle as claimed in claim 2, wherein the third cone angle and the seat cone angle define a third differential angle therebetween and the fourth cone angle and the seat cone angle define a second differential angle therebetween, and wherein the third and fourth differential angles are substantially the same.

5. The injection nozzle as claimed in claim 1, wherein the flow path comprises an axial passage extending at least part way along the valve member, one end of the axial passage communicating with the second supply chamber.

6. The injection nozzle as claimed in claim 5, wherein the flow path comprises at least one radial passage provided in the valve member, the radial passage effecting communication between the first supply chamber and the axial passage.

7. The injection nozzle as claimed in claim 1, wherein the seating surface is defined by the bore.

8. The injection nozzle as claimed in claim 1, wherein the first supply chamber is defined between the valve member and the bore.

9. The injection nozzle as claimed in claim 1, wherein the second supply chamber is defined at a blind end of the bore.

* * * * *